US008474200B2

(12) United States Patent
Gerkes et al.

(10) Patent No.: US 8,474,200 B2
(45) Date of Patent: Jul. 2, 2013

(54) SUSPENDED CEILING GRID SYSTEM

(75) Inventors: Martin Daniel Gerkes, Toronto (CA); Heikki Kolga, Maple (CA); Ronald White, Holland Landing (CA)

(73) Assignee: Decoustics Limited, Woodbridge, ON (CA)

( * ) Notice: Subject to any disclaimer, the term of this patent is extended or adjusted under 35 U.S.C. 154(b) by 0 days.

(21) Appl. No.: 13/328,505

(22) Filed: Dec. 16, 2011

(65) Prior Publication Data

US 2012/0186175 A1 Jul. 26, 2012

Related U.S. Application Data

(63) Continuation-in-part of application No. 12/659,497, filed on Mar. 11, 2010, now Pat. No. 8,079,192.

(51) Int. Cl.
*E04C 2/52* (2006.01)

(52) U.S. Cl.
USPC ..... 52/220.6; 52/506.06; 52/655.1

(58) Field of Classification Search
USPC ..... 52/506.06, 506.07, 506.08, 506.1, 52/656.9, 655.1
See application file for complete search history.

(56) References Cited

U.S. PATENT DOCUMENTS

| | | | | |
|---|---|---|---|---|
| 22,273 | A * | 12/1858 | Atwood | 112/311 |
| 4,019,300 | A * | 4/1977 | Sauer et al. | 52/665 |
| 4,438,613 | A * | 3/1984 | Hintsa et al. | 52/506.09 |
| 4,548,010 | A * | 10/1985 | Hintsa | 52/506.09 |
| 5,241,799 | A * | 9/1993 | Jahn | 52/506.06 |
| 5,428,930 | A * | 7/1995 | Bagley et al. | 52/506.07 |
| 5,535,566 | A * | 7/1996 | Wilson et al. | 52/506.07 |
| 6,029,413 | A * | 2/2000 | Compas, Jr. | 52/506.06 |
| 6,536,167 | B2 * | 3/2003 | Glavan | 52/81.3 |
| 6,971,210 | B2 * | 12/2005 | Kliegle et al. | 52/506.07 |
| 7,478,506 | B2 * | 1/2009 | Wendt et al. | 52/506.07 |
| 7,673,429 | B2 * | 3/2010 | Frecska | 52/506.07 |
| 7,770,338 | B2 * | 8/2010 | Nefzi | 52/81.2 |
| 7,770,349 | B2 * | 8/2010 | Tedesco et al. | 52/506.08 |
| 2003/0230043 | A1 * | 12/2003 | Likozar et al. | 52/506.07 |
| 2004/0118068 | A1 * | 6/2004 | Kliegle et al. | 52/483.1 |
| 2005/0034402 | A1 * | 2/2005 | Johnson | 52/506.08 |
| 2006/0162283 | A1 * | 7/2006 | Moser Rossel | 52/798.1 |
| 2006/0218871 | A1 * | 10/2006 | Wendt et al. | 52/506.07 |
| 2010/0005747 | A1 * | 1/2010 | Tedesco et al. | 52/506.08 |

* cited by examiner

*Primary Examiner* — William Gilbert
*Assistant Examiner* — Gisele Ford

(57) ABSTRACT

A suspended ceiling system has a series of nodes interconnected by grid members to define a grid network. Each node includes a connection plate having a central port area that is adapted to form a recessed part of the finished surface of the ceiling system that is visible between adjacent suspended ceiling panels that conceal the grid members. The connection plate preferably includes grid member connecting arms extending outwardly from the connection plate. The central port area includes a cavity adapted for different purposes. This cavity can receive ceiling components, for example various light fixtures, securing devices or a removable access panel that covers the central port area.

15 Claims, 20 Drawing Sheets

12
50
12
10
10
50
10
10
10
10
8
8
8

Detail A

SUSPENDED CEILING GRID SYSTEM

RELATED APPLICATION

This is a Continuation-In-Part of U.S. application Ser. No. 12/659,497 filed Mar. 11, 2010, and is incorporated herein by reference.

FIELD OF THE INVENTION

The present application is directed to suspended ceiling systems, and in particular to a grid network used to suspend ceiling panels.

BACKGROUND OF THE INVENTION

Examples of suspended ceiling systems are shown in the applicant's earlier U.S. Pat. Nos. 4,436,613 and 5,428,930. The first patent shows a suspended grid system having a series of extruded components that connect to form junction members. These junction members include vertical slots and each individual grid member is received in a slot and secured to the junction member. The individual junction members are suspended from appropriate structural members. Each grid member slidably receives a ceiling panel support bracket along a top edge thereof. These support brackets include slots for receiving extended legs of torsion springs used to suspend the ceiling panel beneath the grid system. The system works satisfactorily but requires specialized components, substantial installation time and expertise in assembly.

U.S. Pat. No. 5,428,930 discloses a system for use in association with a modified 'T' bar suspended ceiling systems providing effective alignment of panels suspended beneath the 'T' bar system. This arrangement is a cost effective solution suitable for rectilinear grid systems and is less suitable for complex installations.

The present invention provides an effective system that has good structural integrity, accommodates complex ceiling systems and has advantages with respect to installation.

SUMMARY OF THE INVENTION

A suspended ceiling system according to the present invention comprises a grid system having a series of visual nodes interior to a peripheral edge of the grid system connecting grid members of the grid system. The series of visual nodes each include a connection plate with a series of arms extending outwardly from a central port of the connection plate, with each arm being mechanically connected to one of the grid members to align the grid members in at least one predetermined configuration. The central port of the connection plate includes a downwardly extending collar about the central port and a visual surface provided at a lower edge of the collar and extending outwardly therefrom and forming part of the finished surface of the ceiling. Each arm of the connection plate adjacent a free end thereof includes a pair of generally opposed elongate connection slots with each elongate connection slot sized to receive a releasable support of a suspended ceiling panel to secure the ceiling panel beneath the grid system and in a predetermined configuration. The visual surface of the visual nodes and the ceiling panels collectively form a lower finished surface of the ceiling system.

According to an aspect of the invention, the at least one predetermined geometric configuration includes at least five arms extending outwardly from the central port.

In a further aspect of the invention, the predetermined geometric configuration includes at least six arms and the central port is rectangular in shape and the ceiling panels are of a triangular shape or diamond shape with truncated corners.

In an aspect of the invention, the connection plate includes six arms, and the projection of the arms defines points of intersection at positions spaced from a center point of the visual node.

In an aspect of the invention, the connection plates are shaped to define a non rectilinear grid when the grid members are connected thereto. In a preferred embodiment, the central port is rectangular in shape having sides of at least 12 inches.

In yet a further aspect of the invention, the central port includes a removable access plate covering the central port at a level spaced downwardly from the bottom surface of the connection plate and spaced upwardly from a finished surface of the ceiling panels.

A suspended ceiling system according to the present invention comprises grid members interconnected by nodes to define a grid network with ceiling panels removably suspended below the grid network.

Each node includes a central port area that remains accessible between adjacent ceiling panels supported about a respective node and forms part of a finished visual area of the ceiling system. The central port area of the nodes receives one of a removable access panel providing limited access to the area above the grid network, a light fixture, a fixed finished conceal panel covering the central port area, a finished panel supporting a security device, audio device or fire related device, or a finished grill structure forming part of an air circulation system. Preferably the finished visual area is at an upwardly offset level relative to a finished surface defined by the lower surface of the suspended ceiling panels.

In an aspect of the invention, each node includes a flat stamped connection plate that includes a central port with a downwardly extending collar about the central port that terminates at a position to abut and partially overlap with the suspended ceiling panels supported adjacent the node.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
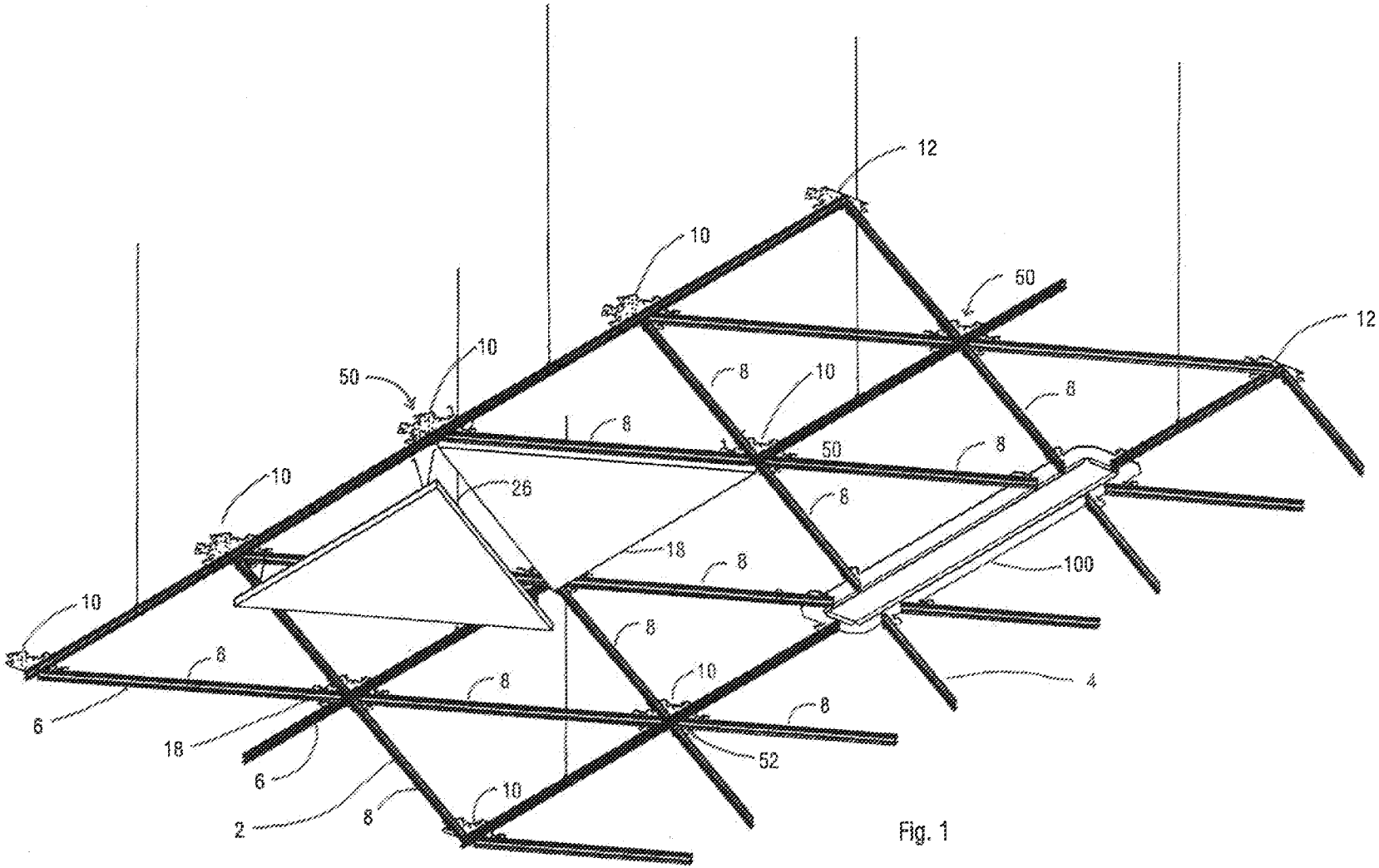
FIG. 1 is a bottom partial perspective view of a suspended ceiling system and grid network with two triangular ceiling panels.

The suspended ceiling system 2 includes a grid system 4 having ceiling panels 18 suspended there below. The grid system 4 is preferably defined by main grid members 6 which extend through aligned intermediate nodes 10 typically in a length of the ceiling system. Secondary grid members 8 connect adjacent nodes. These secondary grid members 8 are of a short length and do not extend through the center of the intermediate nodes 10. A series of edge nodes 12 are provided at the peripheral edge of the ceiling panel system and as shown these are typically half nodes.

Figure 7:
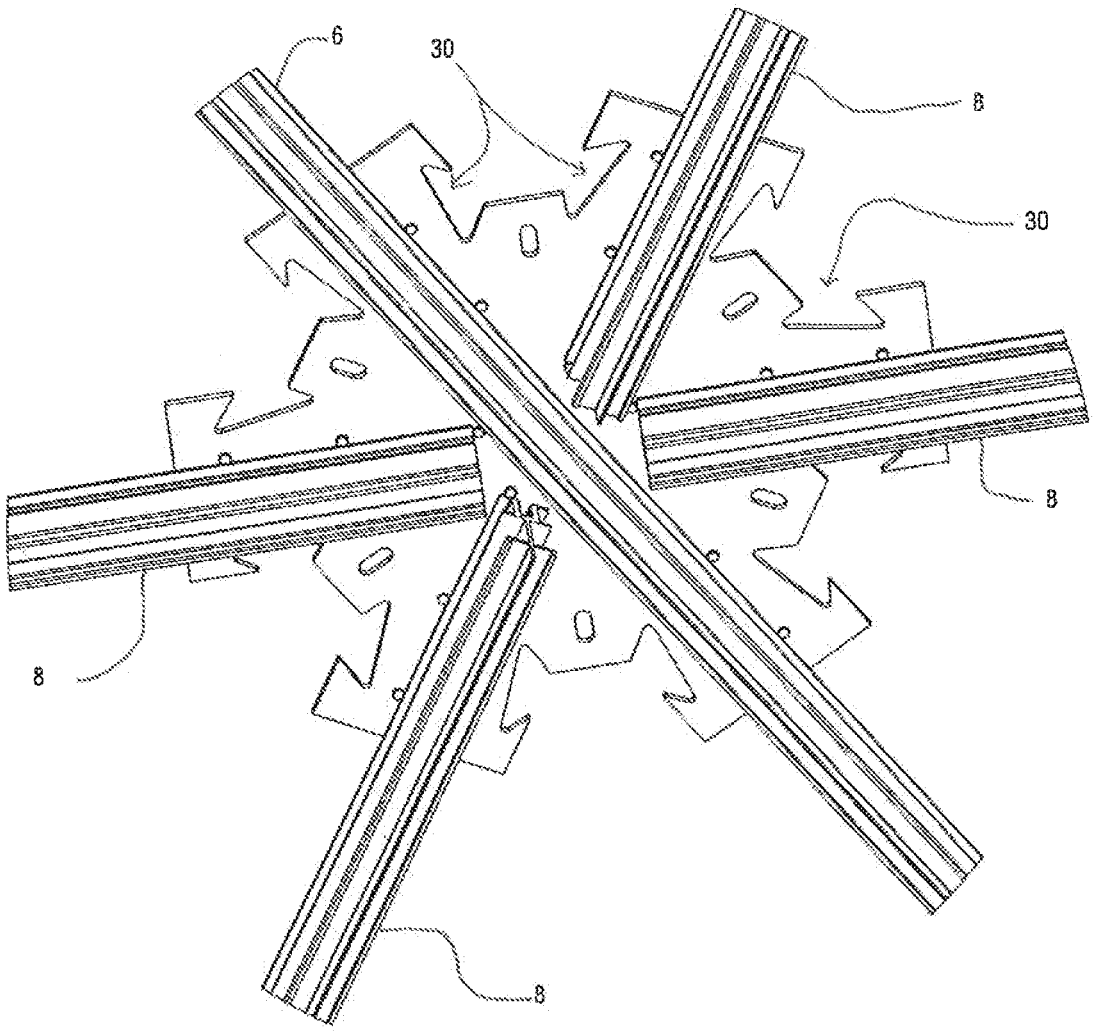
FIG. 7 is a bottom view of the intermediate node of FIG. 5.

The suspended ceiling panels 18 are essentially aligned beneath the grid members and preferably the grid members include a downwardly extending flange 76 (see FIGS. 5 and 7) which provides an alignment surface for engaging the edges of the panels, the ceiling panels cover and conceal the grid system. It is preferred that the grid system define individual cells for each panel. Torsion springs 26 are provided near the corners of the ceiling panels for suspending of the panels beneath the grid system 4. Each of the nodes (i.e. the intermediate nodes 10 and the edge nodes 12) includes torsion spring securing slots 30. These securing slots are provided near an outer edge portion of the intermediate and peripheral nodes and preferably are located in project arm 52 of the nodes.

Figure 3:
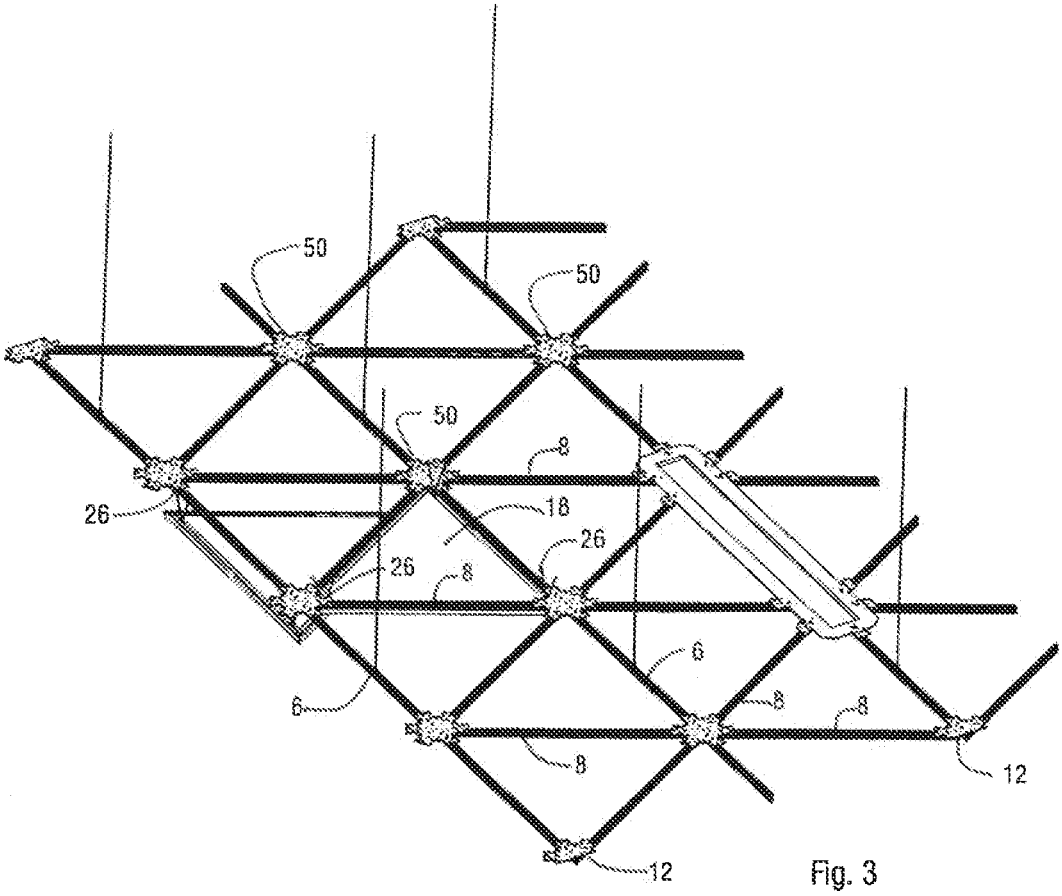
FIG. 3 is a top partial perspective view of the ceiling grid network of FIG. 1.

FIGS. 1 and 3 show a series of intermediate nodes 10 and the use of the connection plates 50 for securing of the grid members 6 and 8 in a desired configuration of the grid system. These connection plates include guide tracks 56 and dimple stops 58 to accurately position the various grid members and thereby accurately define the geometry and size of the cells. This assists in the assembly of the grid network and in the preferred embodiment of the invention, the grid system 4 is assembled at desk or table height. Once the grid system is assembled or partially assembled, it can be raised to the ceiling height and suspended from fixed structural members. The series of main grid members 6 extending through at least some of the connection plates, adds to the structural integrity of the grid system. Also the connection plates 50 form an effective structural connection with the main and secondary grid members.

Figure 4:
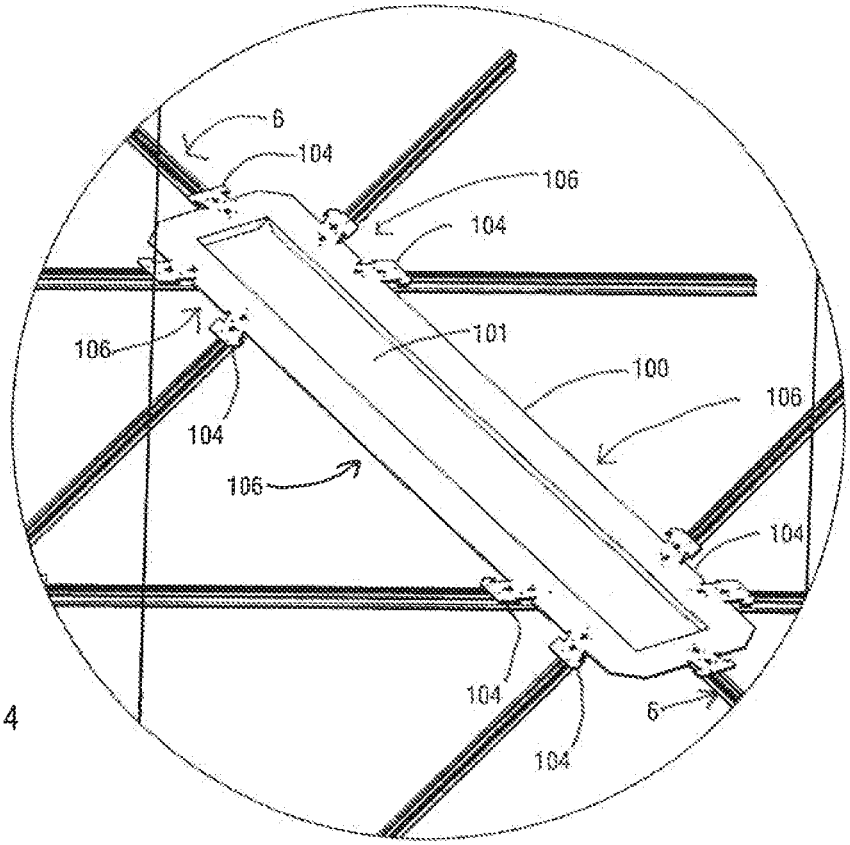
FIG. 4 is a top perspective view of a specialized frame for accommodating lighting fixtures in the ceiling grid network.

The partial perspective view of FIG. 4 includes details of a light connector 100 having an integral frame that forms part of the ceiling grid system and preferable forms part of a main axis with other main grid members 6. An electrical light fixture can be received into the center recess 101 and panels can be suspended at the longitudinal edges 106 of light connector 100. The light connector principle can also be used for other ceiling fixtures including diffuser grates for air ventilation systems and other applications.

FIGS. 2, 5, 6, 7, 8 and 9 show details of the grid members and the connection at an intermediate node using the connection plate 50. A six way connection plate 50 having six projecting arms 52 and each arm is at an angle relative to the adjacent arm of 60°. Each projecting arm 52 is designed to engage and appropriately align either a secondary grid member 8 or a main grid member 6 if the grid network allows for main grid members. Each projecting arm includes guide dimples 54 that collectively define a guide track 56 centered on each arm 52 with this guide track being adapted to engage the top flanges 71 of a main grid member 6 or a secondary grid member 8.

Figure 2:
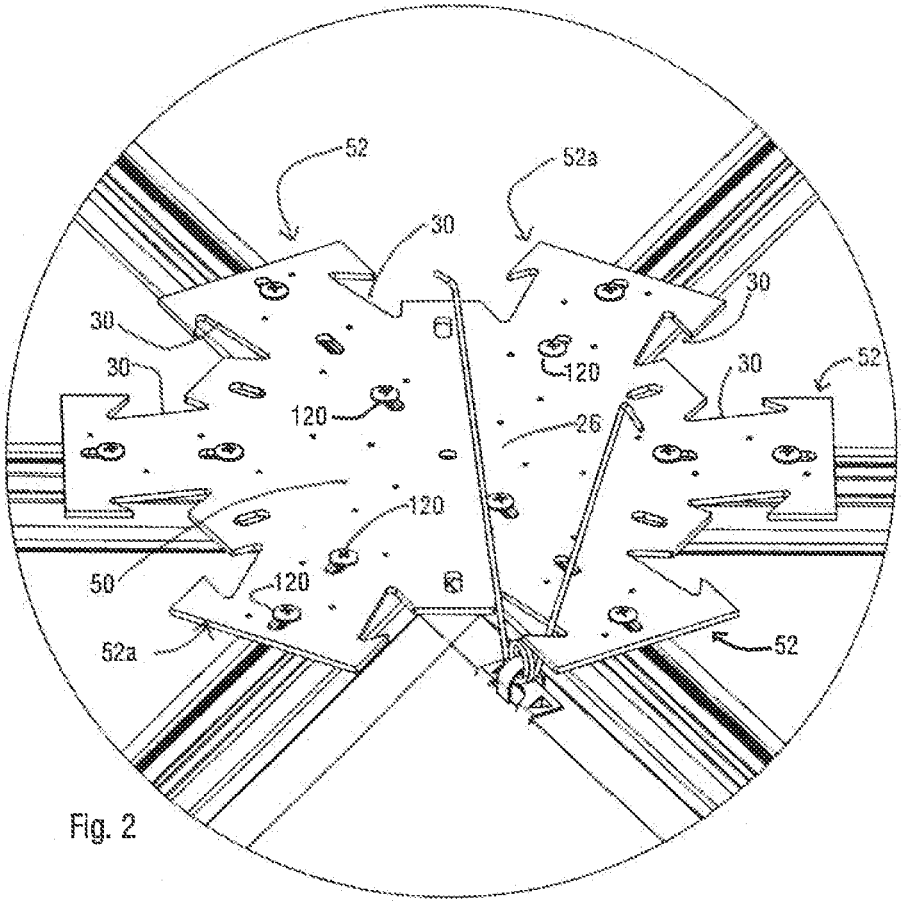
FIG. 2 is a partial perspective view showing an intermediate node of the grid network.
Figure 9:
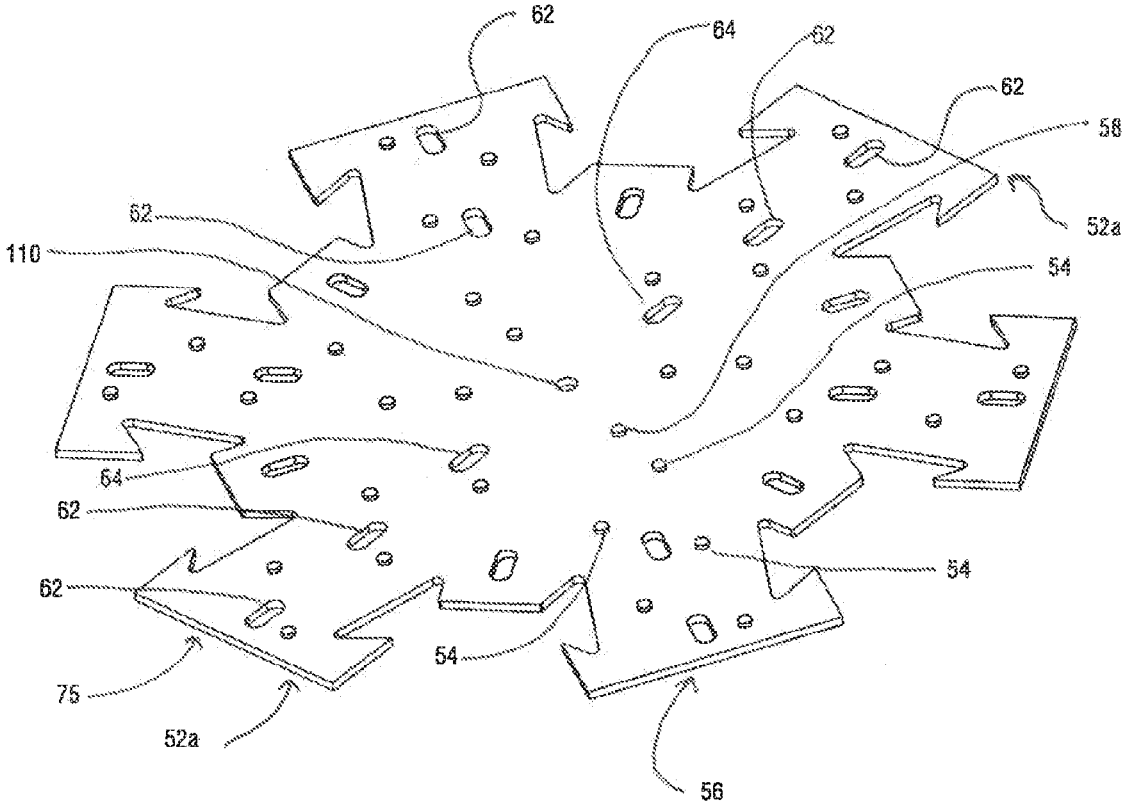
FIG. 9 is a partial perspective view showing details of the connection plate of the intermediate node.

In the preferred connection plate 50 as shown in FIGS. 2 and 9, two aligned projecting arms 52*a* cooperate to define a center guide track which passes through the connection plate 50 and is adapted to engage a main grid member 6. This guide track is generally shown as 75 in FIG. 9. This guide track not only includes securing slot 62 provided in each of the projecting arms 52*a*, but it also includes extended main securing slots 64. These main securing slots are interior to the projecting arms (i.e. the main securing slots are located closer to the center point 110 of the connection plate).

The connection plate 50 includes guide dimples 54, defining the guide tracks and also includes dimple stops 58. Each arm 52 includes guide dimples 54 (i.e. four guide dimples that engage the edges of the secondary grid members 8 to align the grid members relative to the projecting arm.) A dimple stop 58 is associated with each of the projecting arms for engaging a secondary grid member and provides a stop face spaced from the center of the connection plate. The guide track and stop face allow an installer to accurately secure the secondary grid members 8 to the connection plate and accurately define cells of the grid system.

The appropriate connection of the secondary grid members 8 and the main grid member 6 is shown in FIGS. 2, 5, 6, 7 and 8. Each of the projecting arms 52 or 52*a* also include torsion spring securing slots 30 and typically adjacent arms have opposed securing slots 30. These securing slots are spaced outwardly from the center of the connection plate 8 and are also placed outwardly from the ends of the secondary grid members 8. This simplifies securement of the torsion spring to the ceiling panels as the suspension points are positioned along the sides of the panels.

Figure 5:
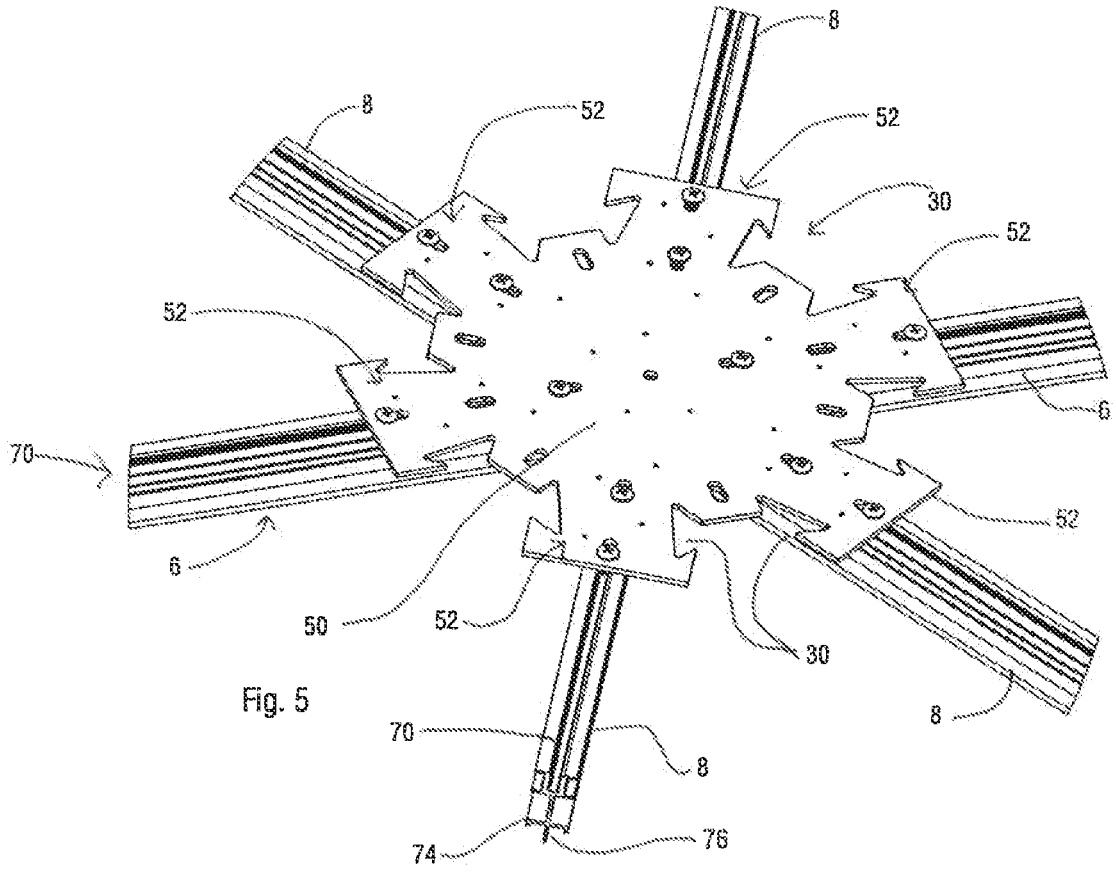
FIG. 5 is a partial perspective view showing a six-way intermediate node of the ceiling grid network.
Figure 6:
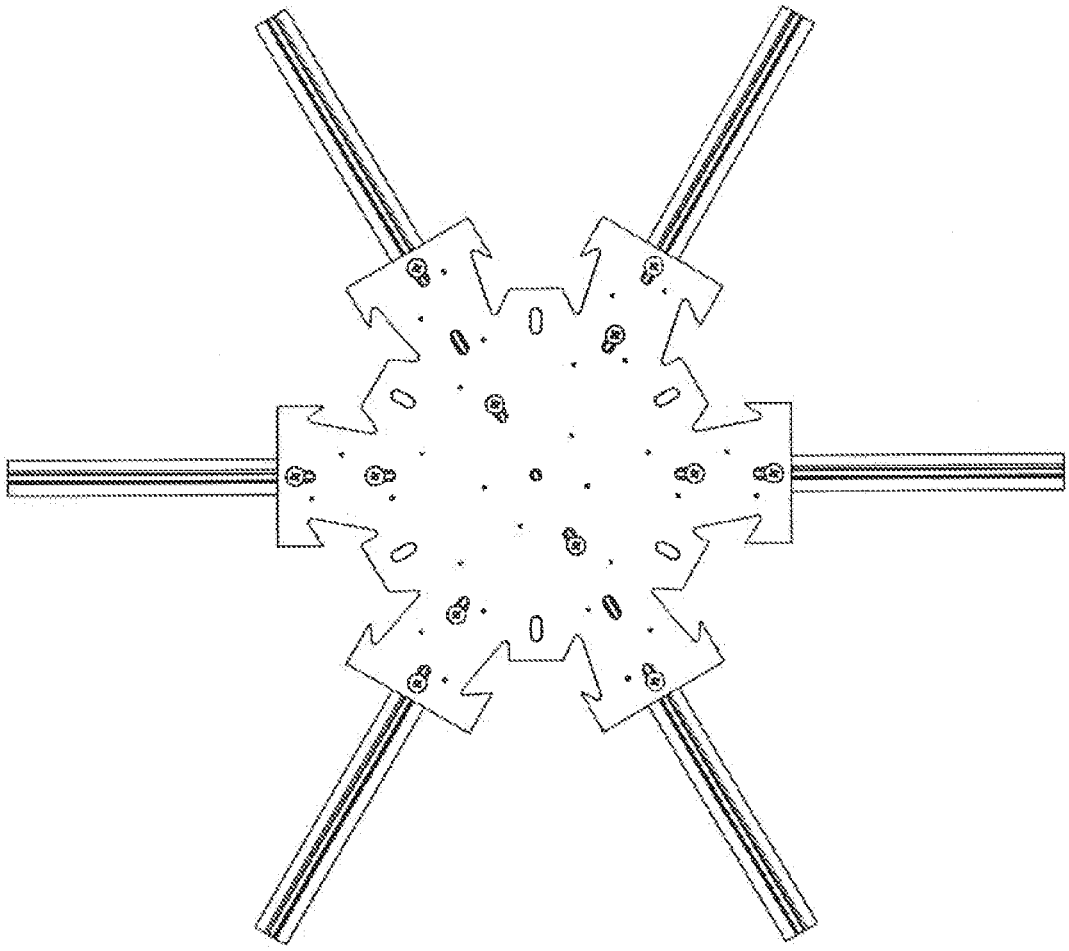
FIG. 6 is a top view of the intermediate node of FIG. 5.
Figure 8:
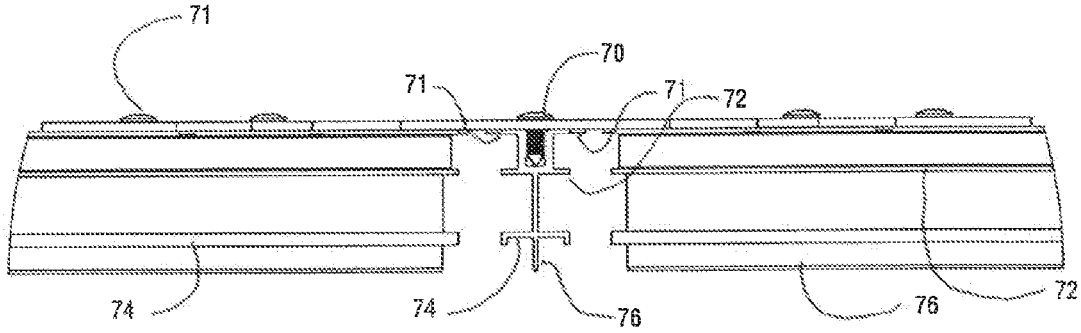
FIG. 8 is an end view of the intermediate node of FIG. 5.

FIGS. 2, 5 and 8 illustrate the cross section of the main grid members 6 and the secondary grid members 8. This cross section is a modified 'I' beam type structure with the securing slot 70 provided on an upper surface thereof for receiving screw fasteners 120 that pass through the connection plate 50.

This slot 70 also includes outwardly extending flanges 71 for positively engaging the lower surface of the connection plate and the guide tracks. The grid members include intermediate cross flanges 72 and 74 and a projecting centered web 76. The grid members of this section are preferably manufactured as an extruded aluminum or aluminum alloy component and are easily cut to the appropriate length. This structure is easily cut at the time of manufacture and can also be cut on site at the time of installation. These members are pre-cut according to the grid system size and shipped to a job site unassembled. Once at the job site appropriate segments of the grid system, for example a portion of a corridor or a portion of a room, are assembled at table height and then raised upwardly once most of the assembly is complete. The grid system can then be secured beneath any structural securing members and connection of segments completed at ceiling height. Typically the connection plate includes a wire connector for securing to the structural components or it may include a threaded rod or other rod type connector. With this arrangement the system is easily adapted to meet local building codes.

The connection plate 50 is preferably punched or diecut and is inexpensive to manufacture. It is sized to overlap beyond the ends of the secondary grid members 8 to allow the torsion spring securing slots 30 to be significantly spaced from the center point of the connection plate.

The particular relationship of the secondary grid members and the main grid member can be appreciated from a review of FIG. 8. It can be seen that the secondary grid members are spaced from the center of the connection plate 50 as the secondary grid members have engaged the various dimple stops 58. The main grid member extends completely across the connection plate 50.

It has been found that the connection plate of the structure is easily manufactured and it can also be manufactured in relatively small run lots.

A more specialized connection assembly for the grid network is shown in FIGS. 4 and 11 through 14. In this case the light connector 100 is used and has an open center recess 101 for receiving a light fixture. The light connector 100 includes a projecting peripheral flange 102 and has a series of projecting arms 104 that extend outwardly from the peripheral flange. Each of these projecting arms include a guide track for receiving the connecting member and guide dimples and a dimple stop are associated with each of the projecting arms as described with respect to connector plate 50. The light connector 100 provides an accurate pattern for assembly of the grid members to accurately define the grid system.

The cooperating suspended ceiling panels abutting the light connector are of a particular size and preferably include a metal frame about the edges thereof. These frames cooperate with the downwardly projecting web of the grid members to accurately position the panels within the cell. The panel shapes are essentially standard with a truncated edge for abutant with the light connector. These modified panels are of a predetermined shape easily manufactured. This allows for convenient assembly on site and accurate connection.

As shown the light connector 100 forms part of the grid system and accurately connects with grid members using projecting arms 104. This determines the panel shapes that cooperate with the light connector 100. The light connector 100 as shown defines two intermediate nodes.

With the system as described and shown in the drawings, it is possible to provide factory produced components to the job site to meet the particular requirements. Once at the job site, these components are assembled and installed to form the ceiling grid system. This grid system reduces installation time, improves quality and requires less skill to install.

Figure 10:
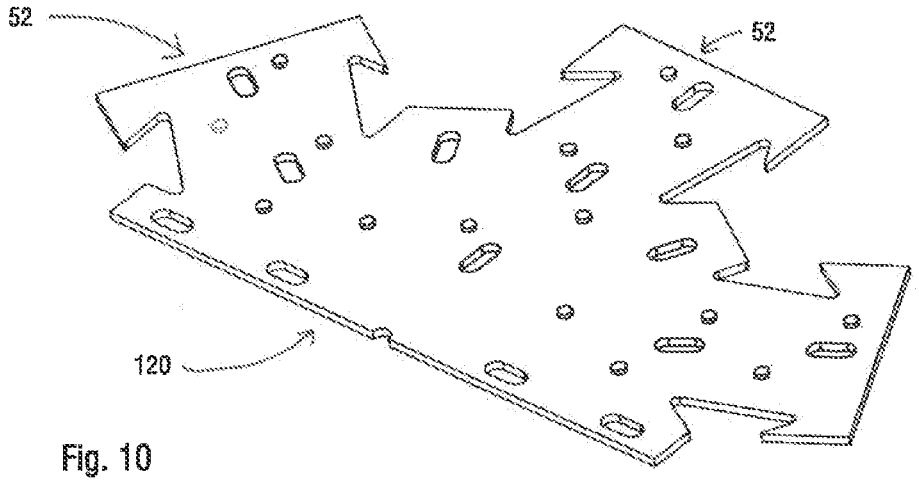
FIG. 10 is a bottom perspective view of a peripheral node.
Figure 11:
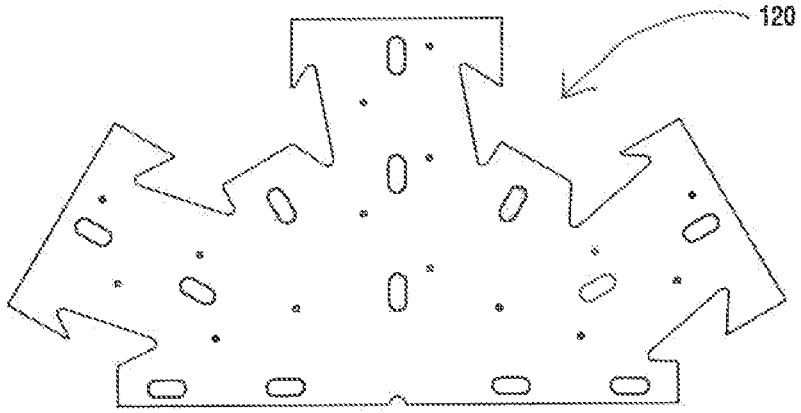
FIG. 11 is a top view of the peripheral node of FIG. 10.
Figures 12, 15:
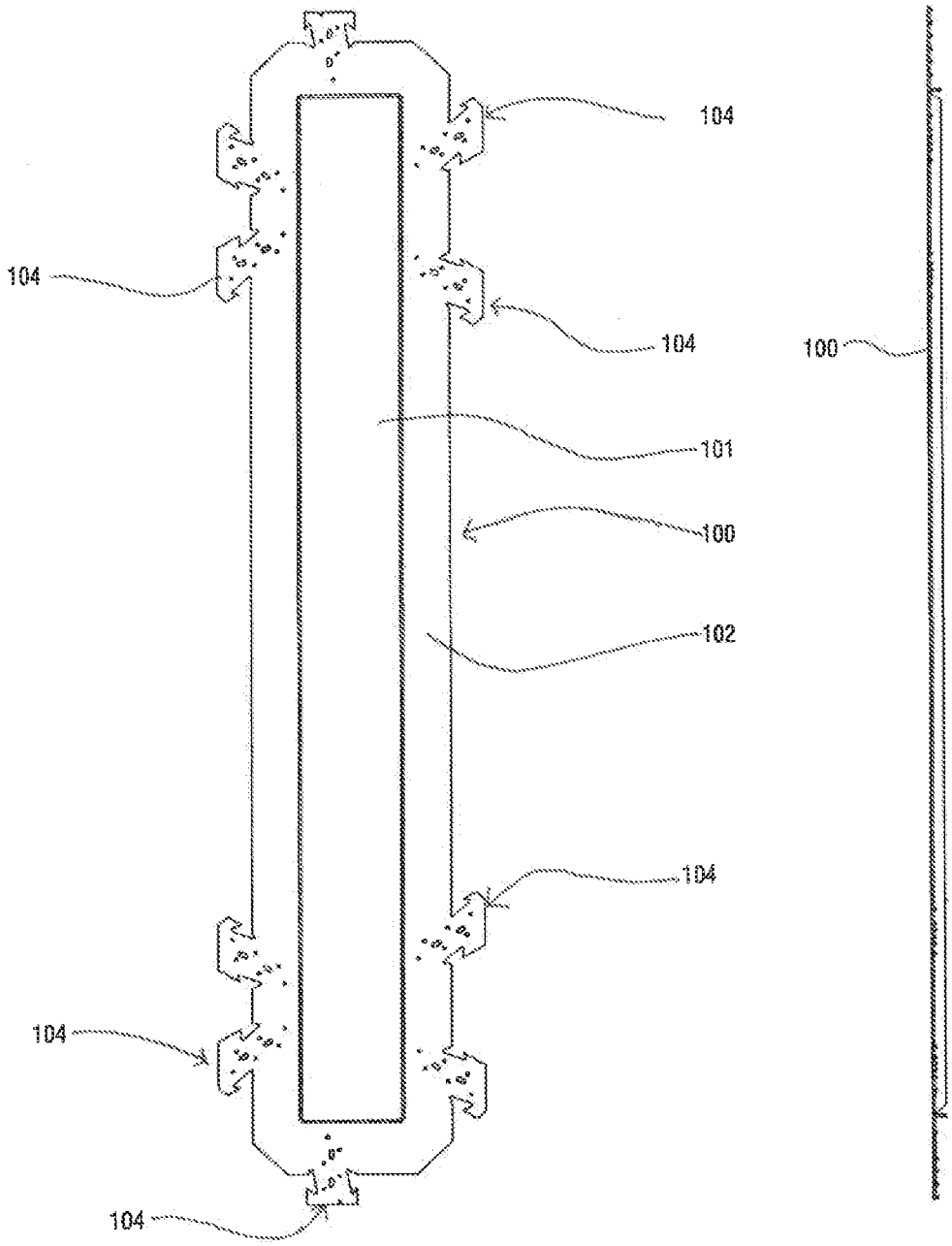
FIG. 12 is a top view of the light connector for a light fixture.
FIG. 15 is a side view of the light connector.
Figure 13:
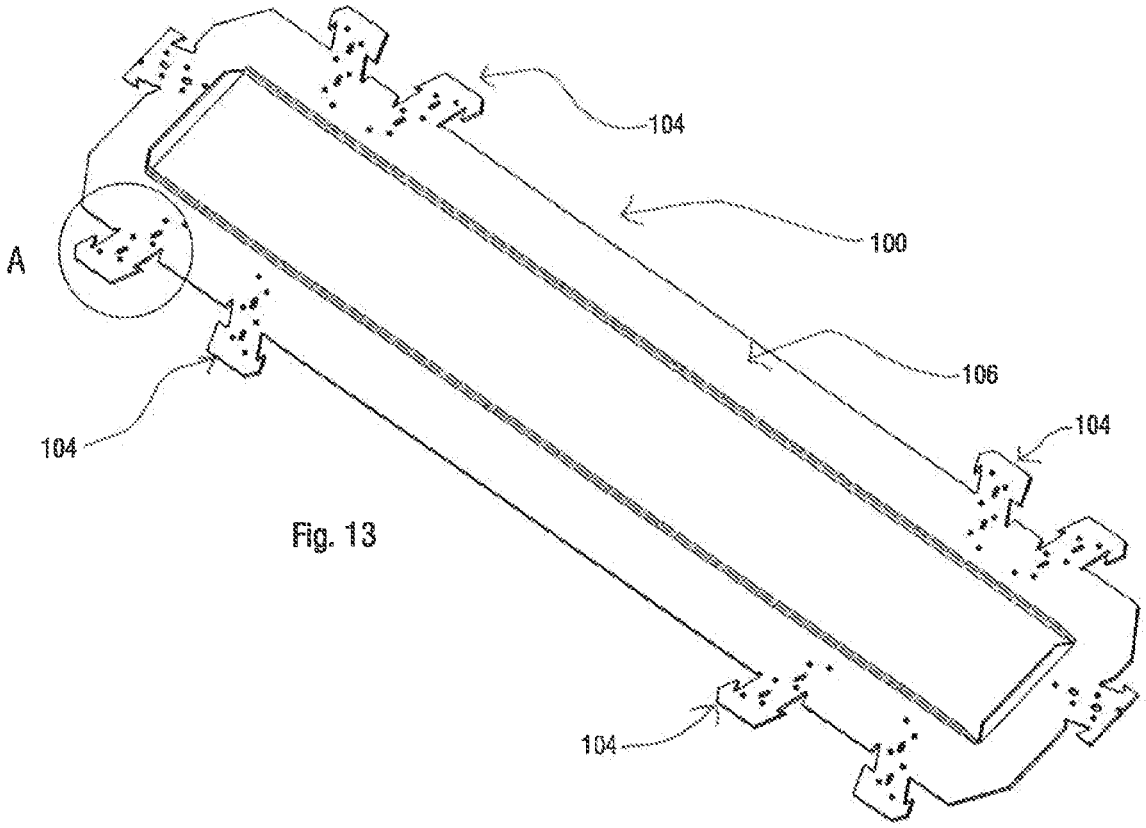
FIG. 13 is a partial bottom perspective view of the light connector.
Figure 14:
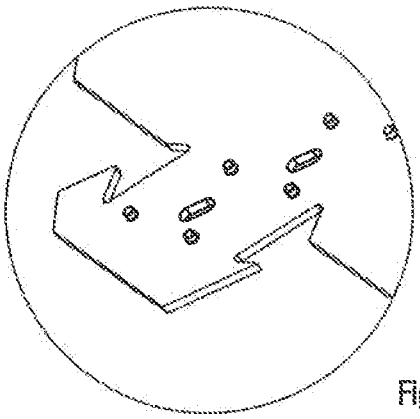
FIG. 14 is a partial perspective view of one of the projecting arms of the light connector.

FIGS. 10 and 11 show details of the connector plates 120 used to define edge nodes 12. Typically the edge nodes are half of the intermediate nodes as the periphery of the ceiling system is generally adjacent a wall. In some cases the edge nodes will be designed to allow connection at an inside special angle between abutting walls. These connection plates include projecting arms, guide tracks, dimple guides and dimple stops to simplify assembly and provide accuracy.

As can be appreciated, the suspended ceiling system is based on engineering drawings and the necessary components are manufactured and provided to the job site. Additional components may also be provided to address job site conditions that are only realized at time of installation. By providing some additional connection plates 50 these can be modified on site to meet the particular needs that may arise.

The system is cost effective to manufacture and cost effective to install.

The system has also been described with respect to a six way connector, however it is also possible to use an eight way connector for defining an octagonal-type grid network. An eight way connector can also be used to allow the suspension of a square panel which is typically defined between octagonal-type ceiling panels. Other grid networks and connection plates allow for custom ceiling solutions. Some of these grid systems will not allow main grid members and only secondary grid members will be used. Therefore, the present system is not limited to the six way system shown that is typically used with equilateral triangles. This system is readily adapted for defining different grid networks as may be required.

An alternate embodiment of the invention is shown in FIGS. 16 through 36. In particular these Figures show a visual node connection which forms part of the alternate ceiling grid system 200. The visual nodes are shown as 202 in the Figures and have a number of different applications and configurations. In contrast to the intermediate nodes 10 described in the first embodiment, the visual nodes 202 are substantially visible and form part of the finished ceiling surface. The suspended ceiling panels conceal the grid members but only partially conceal the visual nodes.

Figure 16:
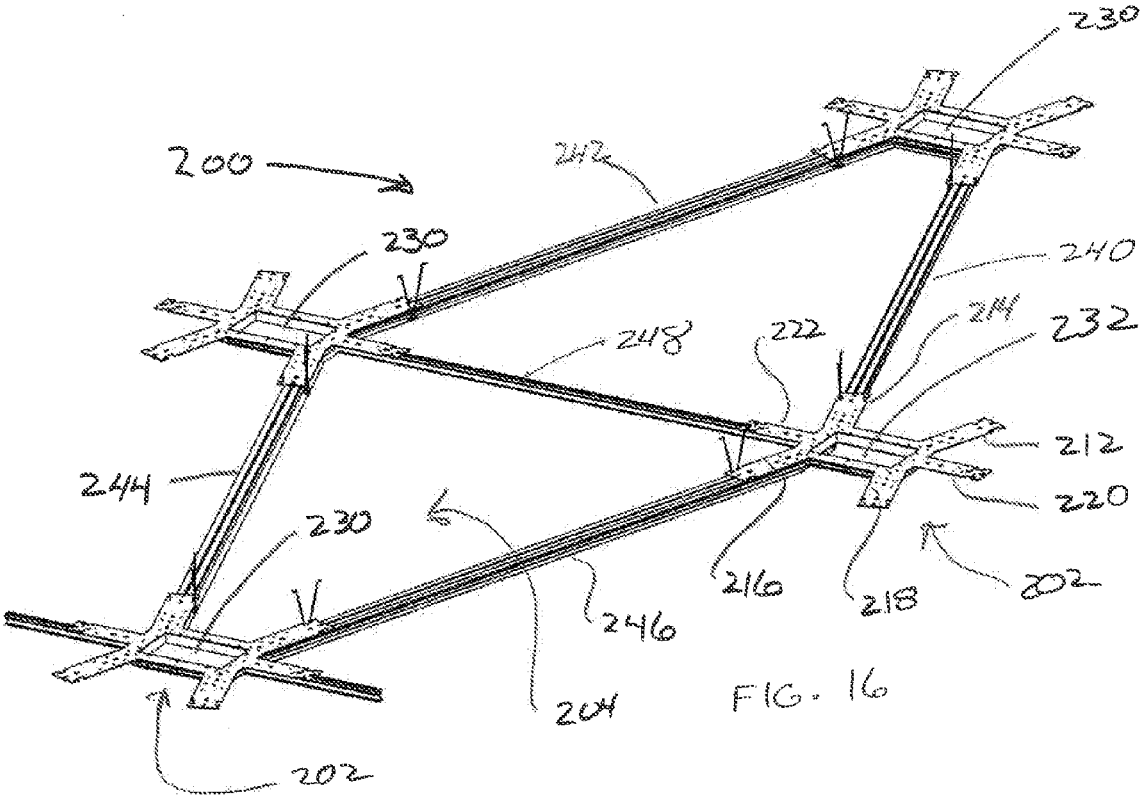
FIG. 16 is a top partial perspective view of an alternate suspended ceiling system with oversized visual node.
Figure 17:
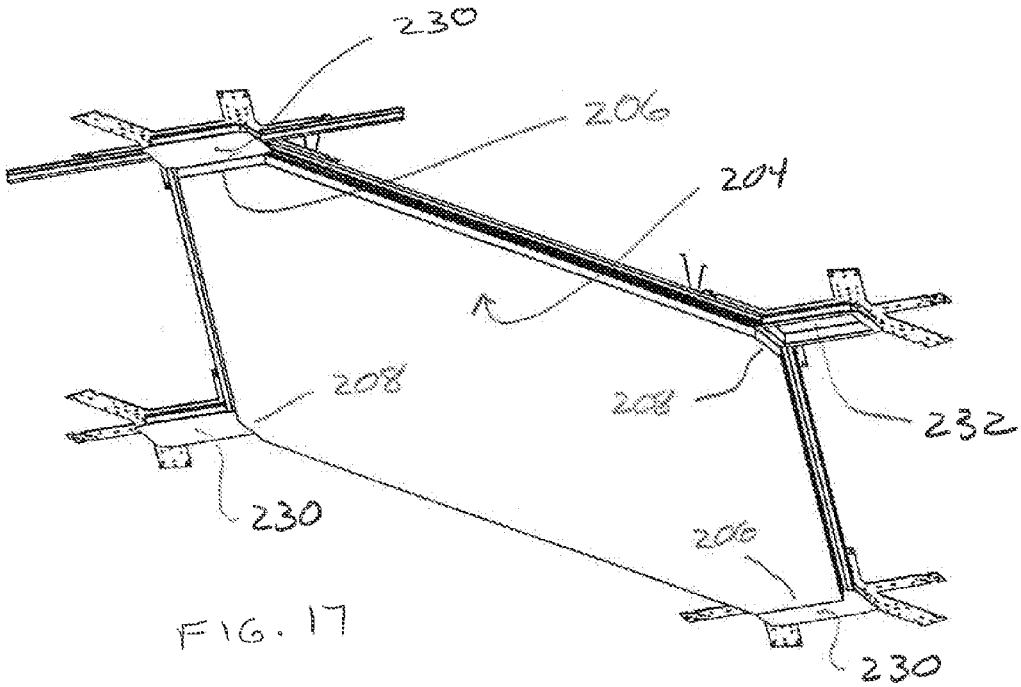
FIG. 17 is a bottom partial perspective view of the alternate ceiling system.

FIG. 16 illustrates the typical function of the visual node 202 for joining the peripheral grid members 240, 242, 244 and 246 and an intermediary support grid member 248. These grid members support the large diamond shaped ceiling panel 204 suspended beneath the peripheral grid members 240, 242, 244 and 246 as shown in FIGS. 16 and 17. The intermediary support grid member 248 provides central support as the diamond shaped ceiling panels 204 are large in size and otherwise might sag. Various points of attachment can be provided on the back or through the panels without being visible on the finished ceiling surface. Such diamond shaped panels can be manufactured in lengths up to approximately 12 feet and the intermediary support grid member 248 is used to provide intermediary support in the center of the diamond shaped ceiling panel.

It can be seen with the ceiling design of FIGS. 16 and 17 that the diamond shaped panel 204 and the rectangular shaped portion 230 of the visual nodes 202 cooperate to form the finished ceiling surface. The visual nodes 202 include arms 212, 214, 216 and 218 for receiving peripheral grid members and arms 220 and 222 for supporting the intermediary support grid members 248. If the ceiling grid used generally triangular shaped panels then the intermediary grid members 248 would be peripheral grid members.

In the design as shown the arms 212, 214, 216, 218 and the arms 220 and 222 do not all pass through a center node position. This visual node 202 includes the rectangular ceiling portion 230 which serves to alter the grid such that arm 214 does not pass through a center point common with arm 218. These arms have been offset to accommodate for the rectangular ceiling portion 230. If this portion was square in shape the offset would not be required.

As shown in FIG. 16, the rectangular ceiling portion 230 extends downwardly from the arms for the grid members and can be selected to be at the finished surface of the ceiling panel, partially upwardly recessed relative to this finished surface or could extend slightly downwardly therefrom. Typically the surface 230 is finished in a similar manner or in a desired manner to form a finished portion of the ceiling.

Figure 18:
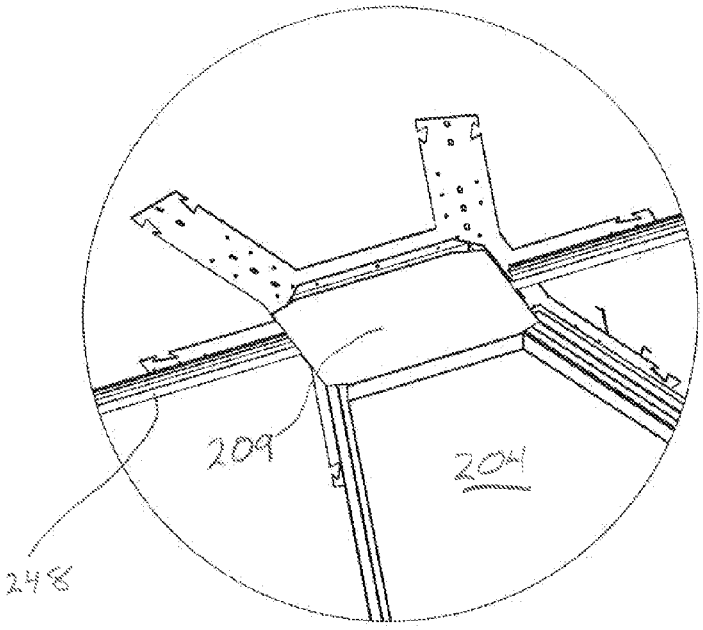
FIG. 18 is a partial perspective view of a visual node with a suspended ceiling panel.
Figure 19:
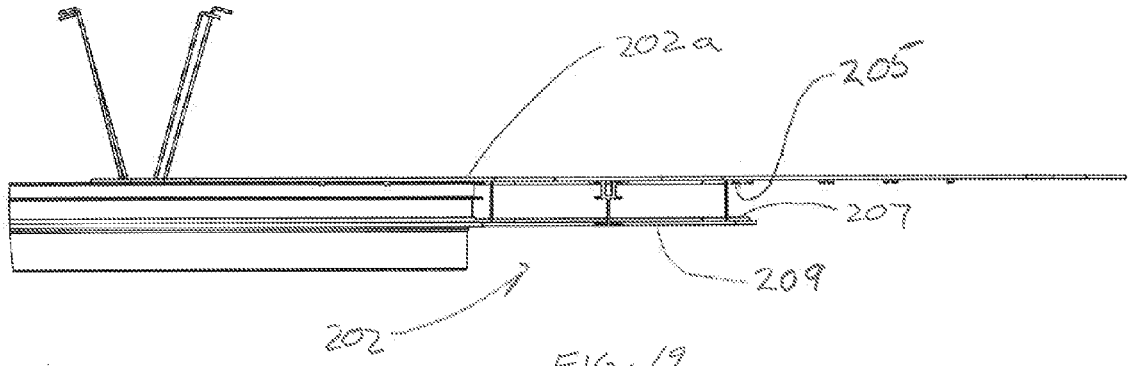
FIG. 19 is an elevation type view of a visual node of FIG. 17.
Figure 20:
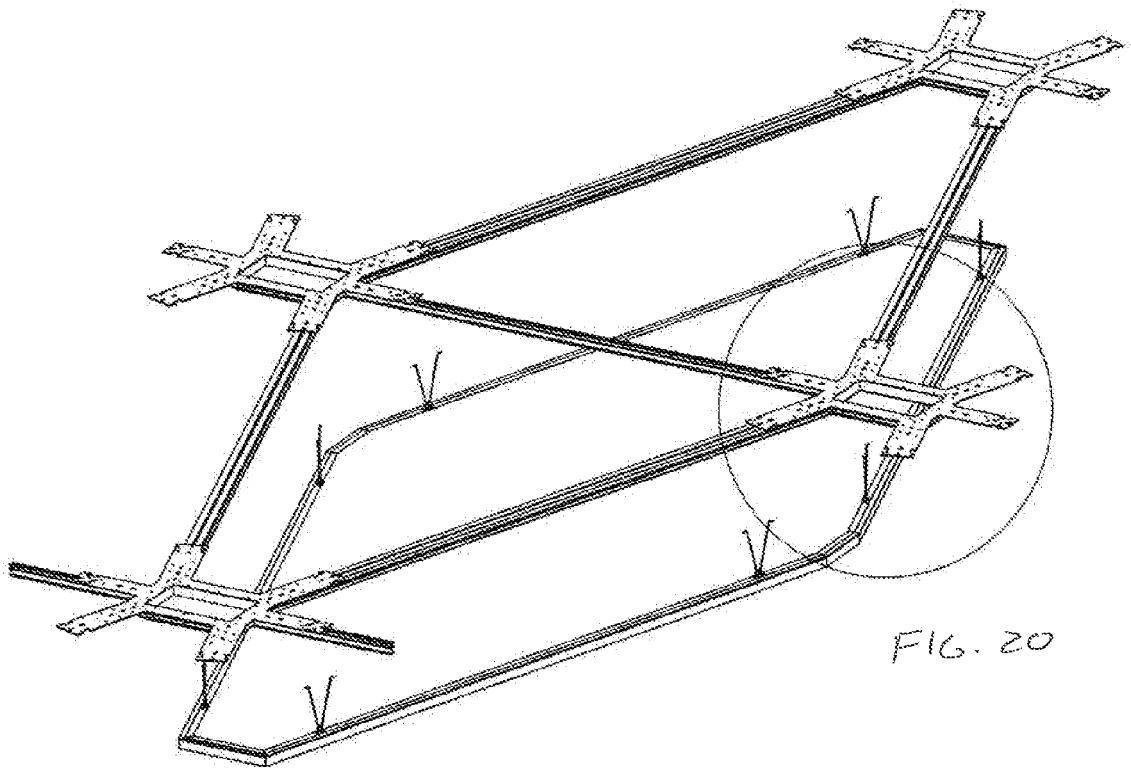
FIG. 20 is a partial perspective view of the alternate ceiling system with ceiling panel being positioned for suspension.
Figure 21:
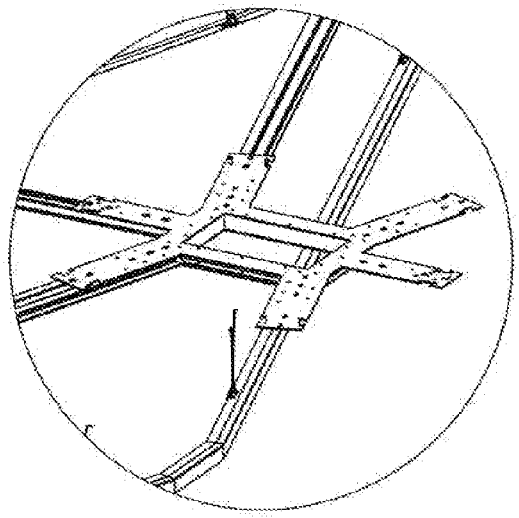
FIG. 21 is a is a partial perspective view of the node and panel of FIG. 20.
Figure 22:
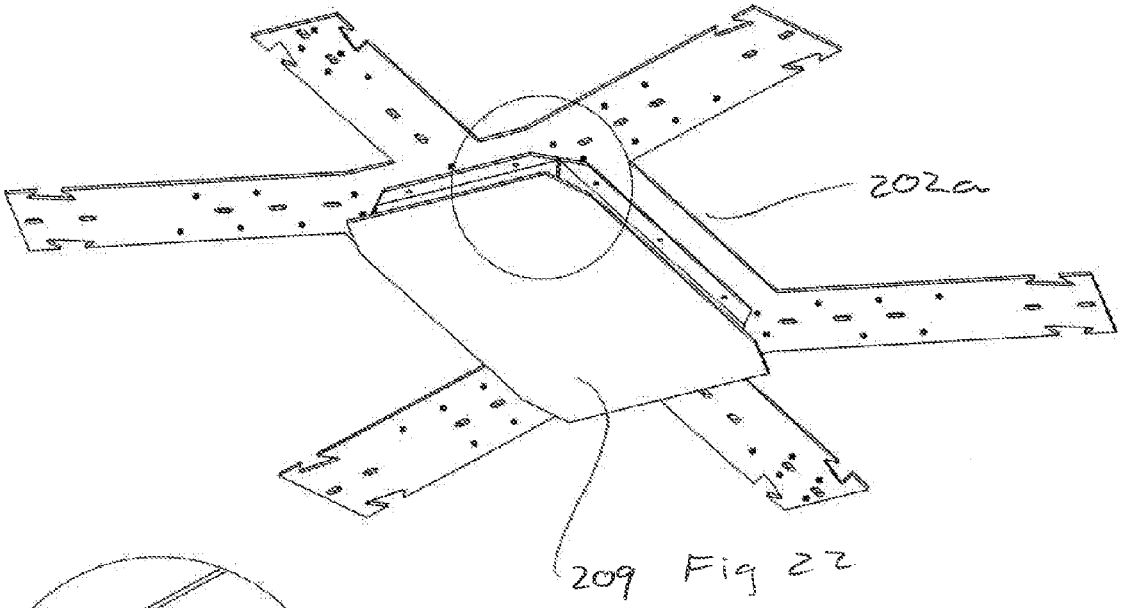
FIG. 22 is a is a perspective view of a visual node with a fixed cover plate.
Figure 23:
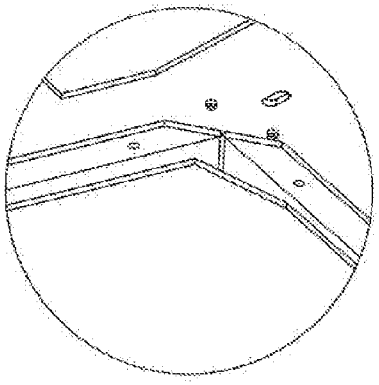
FIG. 23 is a partial view of the visual node of FIG. 22.
Figure 24:
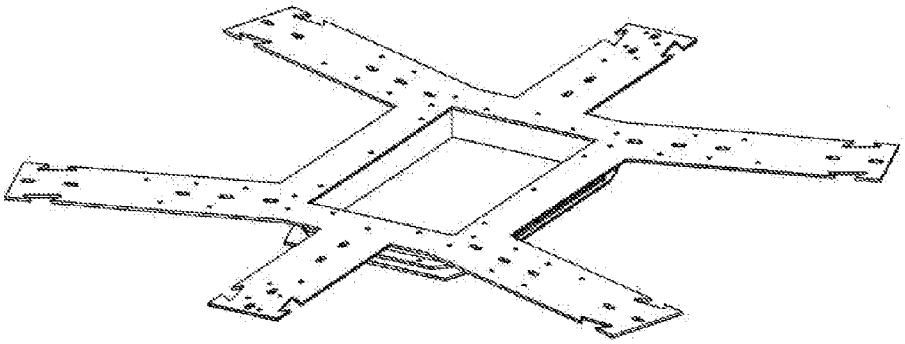
FIG. 24 is a top perspective view of the visual node of FIG. 22.

In a preferred embodiment as shown in FIGS. 16, 17 and 18 the ceiling portion 230 is upwardly recessed and in abutment with a back surface of adjacent ceiling panels.

Also shown in FIG. 17 is an alternate embodiment where the visible node includes an open port 232. This open port includes a peripheral frame about the port that is partially visible and forms part of the finished surface of the ceiling panel. This port can also receive a number of specialized members (for example to accommodate a light, a ventilation port, an alarm sensor, an access port or a security sensing device). Rather than hiding the visual node as was done in the embodiment of FIGS. 1 through 15, the visual node 202 is designed to have a center port area having a lower surface, preferably recessed relative to the panels, that forms part of the finished surface of the ceiling. The size of the visual node has increased substantially yet it continues to function as a junction point for the peripheral grid members of the ceiling grid system.

As shown in FIGS. 16 and 17, the diamond shaped ceiling panel 204 includes long truncated ends 206 and short truncated corners 208. The lengths of these truncated ends are a function of the size and shape of the portion of the visual nodes 202 that form part of the ceiling surface. A rectangular shape has been shown but it can be appreciated that other shapes are possible such as octagonal, circular, oval, triangular or other shapes, and this will require the ceiling panel to appropriately complement these shapes.

FIG. 18 shows the diamond shaped ceiling panel 204 about to be raised upwardly against the ceiling grid system that includes the visual nodes 202. Three of these nodes 202 include the downwardly offset closed rectangular ceiling portion 230 and one of these nodes includes the open rectangular ceiling port 232 that can receive different ceiling structures or devices.

In large size panel systems, although the panels can be downwardly removed to allow access to the area above the grid network, it is desirable to provide a visual node that accommodates limited access to an area adjacent the node and above the grid work. In addition, a visual node can accommodate other devices or structures such as lighting, sensors, security or air handling structures. By providing these devices at node locations the ceiling panels remain uninterrupted and thus the requirement to modify the ceiling panels at the time of manufacture or in the field to accept such a device is reduced or eliminated.

Typically in the past, ceiling panels have been ported to accommodate sprinkler heads and more recently may have been ported to accommodate security type sensors or cameras. By providing a ceiling system where the nodes are already providing support for the ceiling grid system, the nodes are advantageously used to additionally support other equipment or provide an accent surface for the ceiling. Thus the ceiling panels in combination with the desired functionality of the visual nodes provide the finished ceiling.

Figure 25:
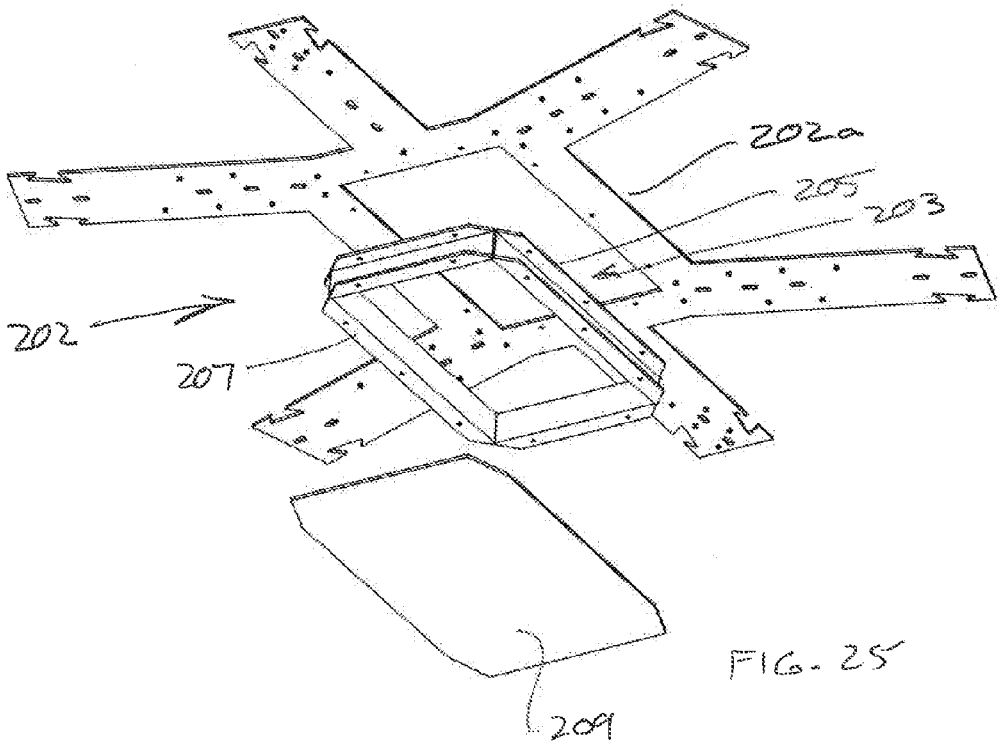
FIG. 25 is an exploded perspective view of the node of FIG. 22.
Figure 26:
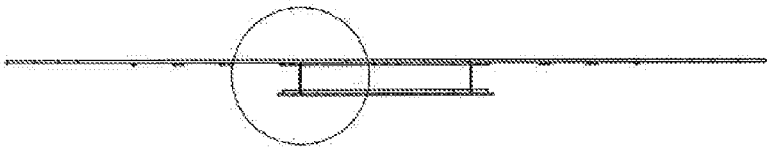
FIGS. 26 and 27 are side views of the visual node of FIG. 25 when assembled.

Furthermore, with this design the direct alignment of the grid members in forming the grid system or shifting need not be followed and the nodes can allow an offsetting or shifting of the grid members. This provides additional freedom with respect to panel shape and provides a further visual distinction of the ceiling system. This is particularly desirable in custom ceilings where architects may wish to provide a distinctly different visual effect. This visual node system allows the architects to design substantially different grid systems where the panel sizes and corners are easily modified to provide a desired visual effect. Furthermore these visual nodes allow the designers to place lighting and/or sensors at selected points in the ceiling grid system in non panel areas and, also provide flexibility for later modification. As can be appreciated, a finished visual node such as 230 can easily be drilled or ported to allow for a retrofit sensor or light, for example. The lower finished surface can also be completely removed by breaking a number of discreet securement points. Also an access port as shown in FIGS. 25 and 26 can be replaced with a panel for supporting a desired device.

A further aspect of the visual node 202 is the ability to select the height of the finished surface of the node that will form part of the ceiling system. In the examples shown in FIGS. 17 through 21 the finished surface of the visual node is spaced downwardly of the connection plate but upwardly of the finished surface of the panels. The finished surface abuts with the rear surface of the panels. Thus the finished surface of the visual node is recessed relative to the finished surface of the ceiling panels.

It can also be appreciated that the central port area of the visual node could include a longer collar and be recessed above the grid system to provide a further visual effect or additional space for accommodating sensors or lights. One such example is a light fixture which uses the space above the visual node as shown in FIGS. 30, 31, 32 and 33. As can be seen, the light fixture 300 is supported above the visual node and above the grid members. The fixture includes its own electrical connecting box 302 and can be appropriately secured to the connection plate. The fixture includes a downwardly projecting lens member 304 which is sized for receipt in the rectangular ceiling port 232. In this way the light fixture can be designed to extend through this port and yet it is supported from above the port. This simplifies the securement of the light fixture to the grid system the light fixtures can all be installed prior to the suspension of the ceiling panels beneath the grid network.

It is also possible for the finished surface of the visual node to be at a level between the rear surface and the finished surface of the ceiling panels. A stopped flanged collar could be used to engage the rear surface of panels but extend beyond the rear surface.

Figure 28:
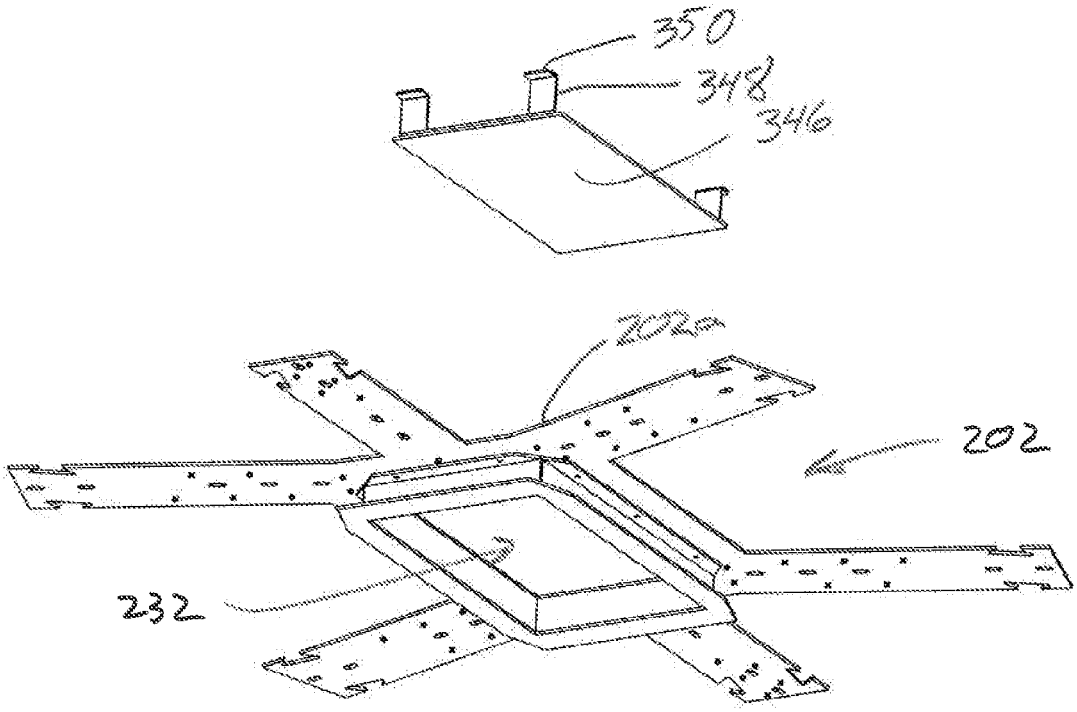
FIG. 28 is an exploded perspective view of a visual node with a removable access panel.
Figure 29:
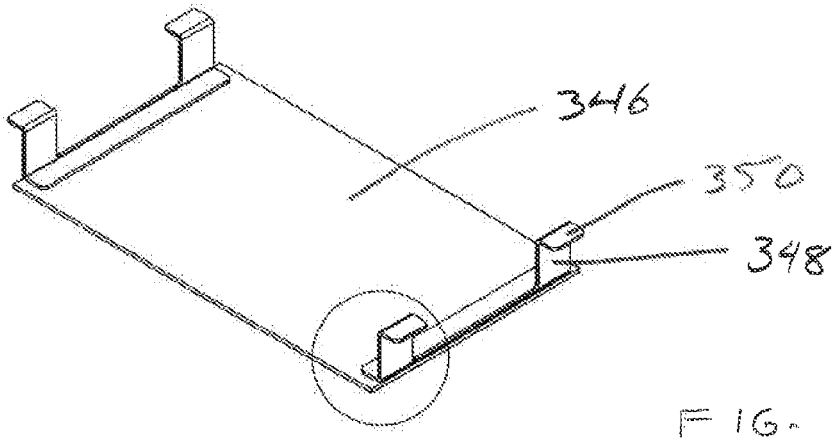
FIG. 29 is a top perspective view of the removable access panel.
Figure 30:
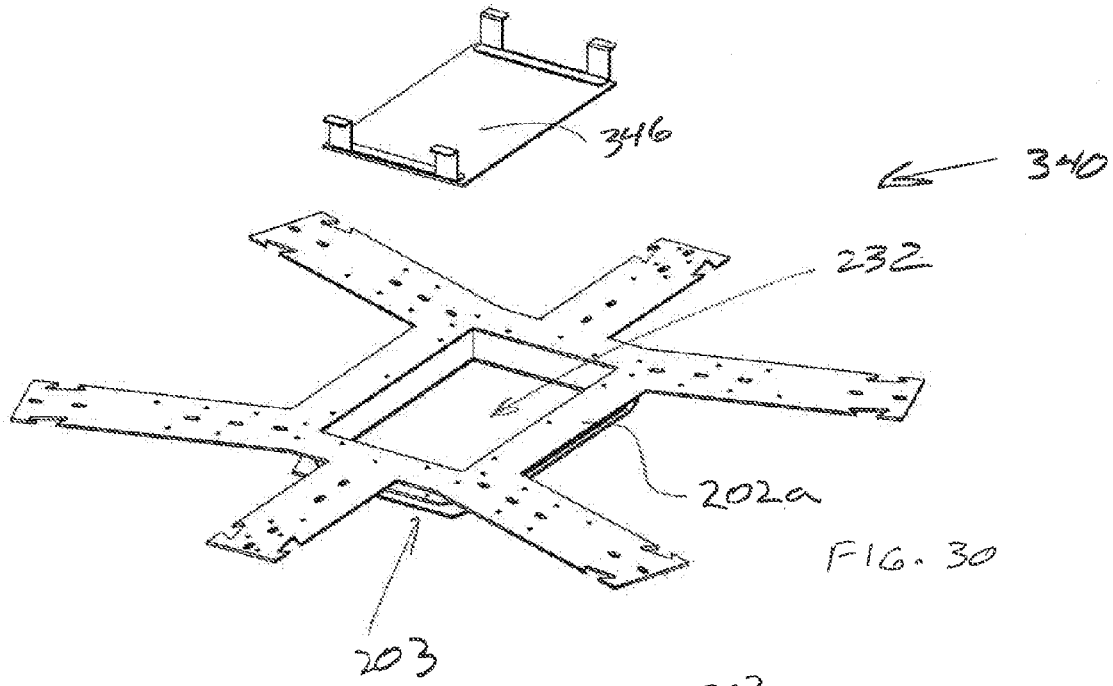
FIG. 30 is a top perspective view of the visual node with access panel in a partially removed state.
Figure 31:
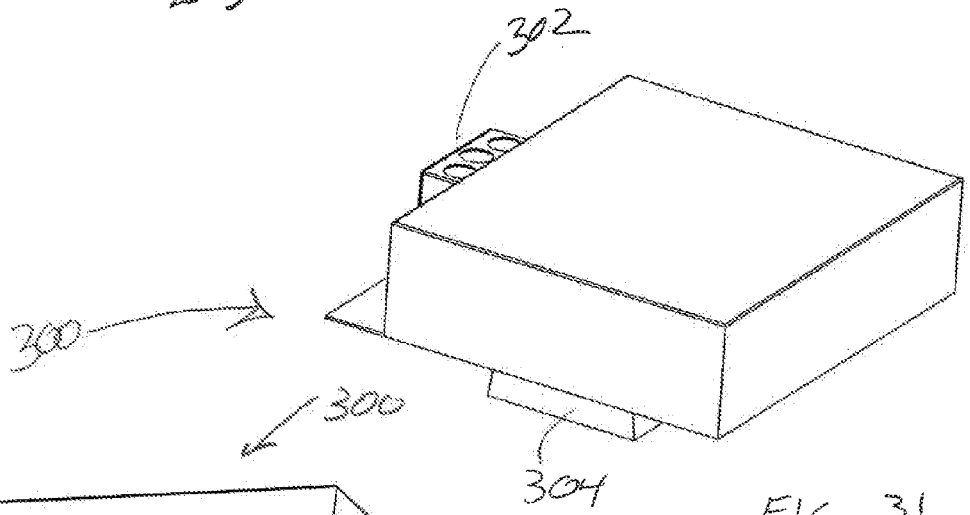
FIGS. 31 and 32 are top and bottom perspective views of a light fixture receivable in a visual node.
Figure 32:
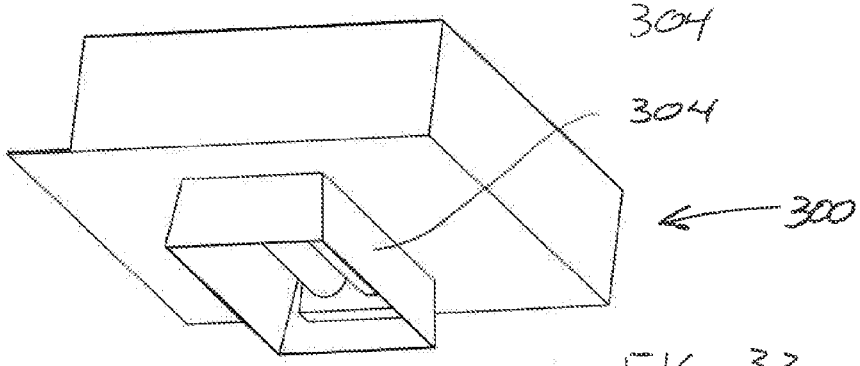
Figure 33:
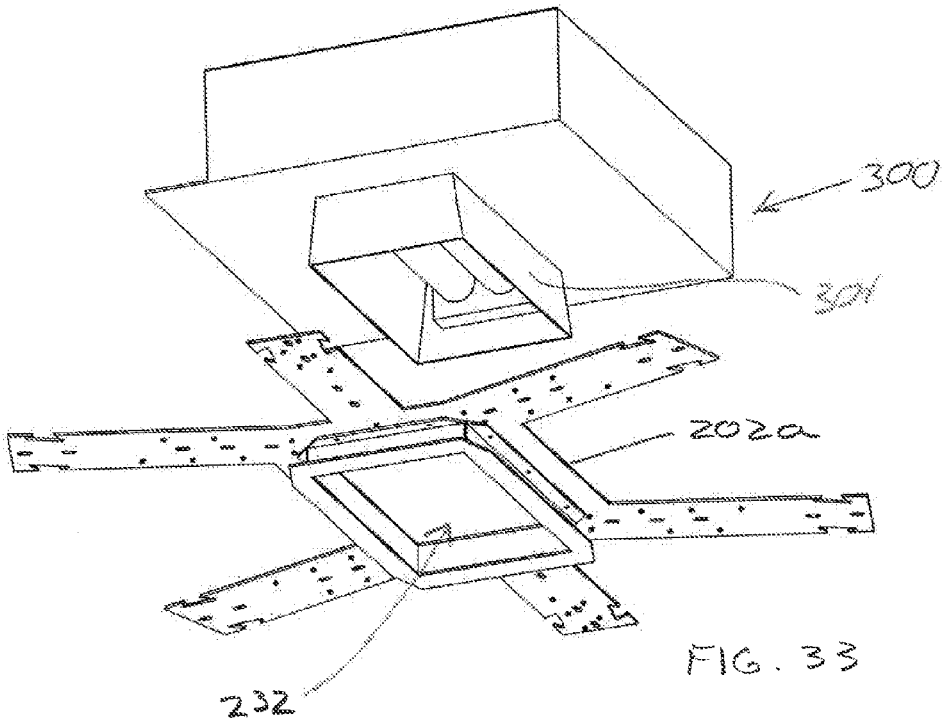
FIGS. 33 and 34 are top and bottom perspective views of the light fixture about to be received in a visual node.

An access port 340 is shown in FIGS. 28, 29 and 30 that includes the rectangular ceiling port 232 in combination with an access plate 346. This access plate includes upwardly extending leg members 348. These leg members include outwardly extending portions 350 that effectively engage the upper surface of the visual node 202 or the rear surface of the connection plate. The space above the grid members can be easily accessed by pushing upwardly on the access plate 346 and shifting it sideways relative to the grid network. This provides a reasonably sized access port for quick access to the space above the ceiling panels and may be useful for running wires or communication wires or for merely checking on the grid network, or changing one node to a different type of node.

Figure 27:
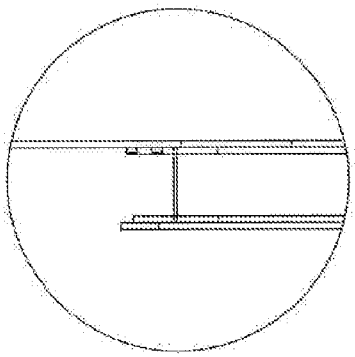

FIGS. 25, 26 and 27 show the three part component of the visual node 202. In this visual node there is a stamped connection plate 202*a* that includes all the arms and the various punch points and end stops for receiving of the grid members in a desired manner. These grid members can be mechanically secured to the arms as described with respect to the original embodiment. The visual node 202 includes a collar portion 203 that extends downwardly from the connection plate 202*a*. This collar portion includes an outwardly extending peripheral flange 205 that is used for securement with the connection plate 202. Typically a weld-type connection is made between these components however any suitable connection can be used. The collar 203 also includes a lower peripheral flange 207 that in one embodiment fixedly secures the cover plate 209. Typically the cover plate 209 is welded to the lower flange 207 and then is appropriately finished according to the desired ceiling effect. Basically the node shown in FIG. 26 would be a node where a lighting fixture is not required or where a sensor would not be required and thus just forms a recessed finished surface of the ceiling system that is offset relative to the finished surface of the ceiling panels.

With the system as described the suspended ceiling panels stop at the periphery of the central port leaving it open but concealing the grid members and arms of the connection plate.

Figure 34:
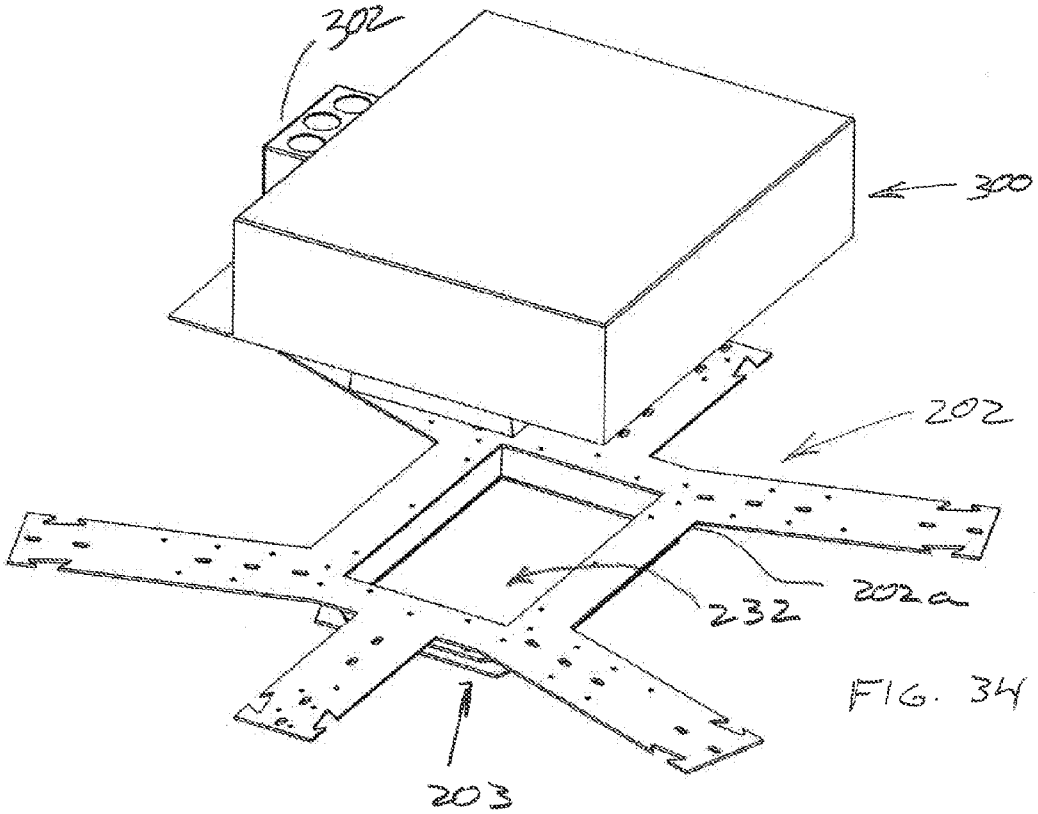
Figure 35:
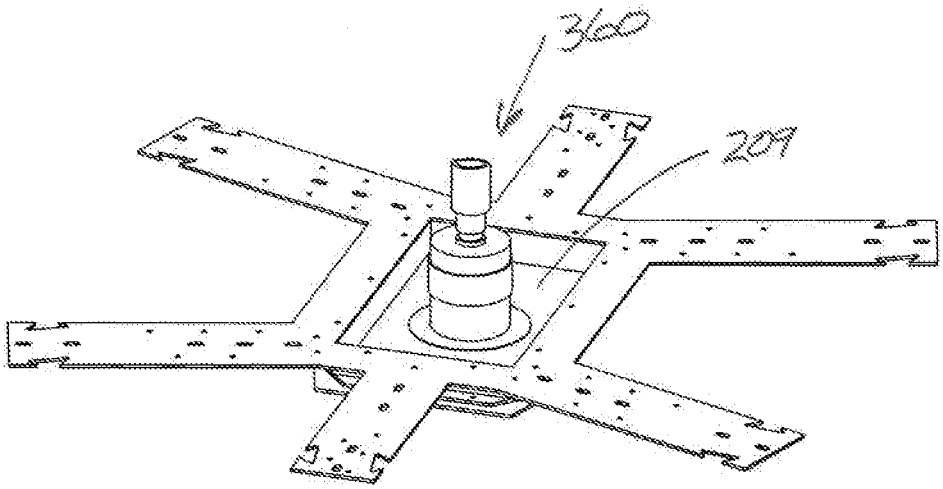
FIGS. 35 and 36 are top and bottom perspective views of an electrical device received in the visual node.
Figure 36:
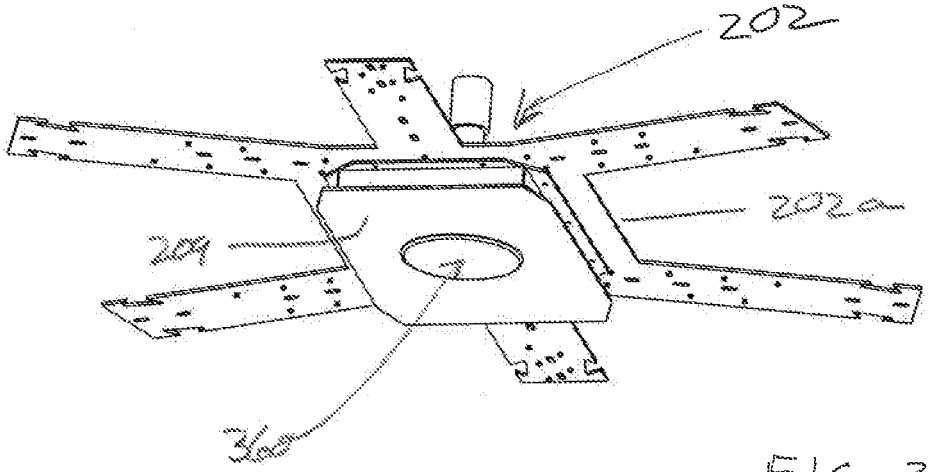

Additional embodiments showing the functionality of the visual node are shown in FIGS. 34 and 35. In FIG. 34 a security type device 360 has been mounted directly to the plate member 209. This plate member could have been prepunched to receive this sensor and/or it could be a field retrofit where it was found that an additional sensor was required. As can be seen, the active part of the sensor can extend below the finish plate 209 as shown in the embodiment of FIG. 35.

It can also be appreciated that other devices can be installed in the ceiling and in particular this arrangement allows for selective placement of speakers and/or microphones and air handling ports or grills.

The fabricated design of the visual node 204 is particularly advantageous for specialized or custom ceilings. For many industrial applications including museums, theatres or other public buildings, architects typically provide a ceiling system that meets a cost and functional standard, however the ceiling may also be a signature or design type feature for the building. The fabricated assembly of the visual node as shown allows for economical manufacture. These types of ceilings are not typically mass produced and as such the volumes are low. This fabricated node structure and the ability to fabricate a visual node that meets different layouts is quite effective. For example, the design accommodates the offsetting of grid members and the flexibility to easily accommodate different ceiling devices. In this way a custom ceiling is possible that is cost effective to manufacture and install.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A suspended ceiling system comprising a grid system having a series of visual nodes interior to a peripheral edge of said grid system, connecting grid members of said grid system;

said series of visual nodes each including a connection plate with a series of arms extending outwardly from a central port of said connection plate, with each arm being mechanically connected to one of said grid members to align said grid members in at least one predetermined configuration;

said central port of said connection plate including a downwardly extending collar about said central port and a visual surface being provided at a lower edge of said collar and extending outwardly therefrom and forming part of the finished surface of the ceiling;

each arm of said connection plate adjacent a free end thereof including a pair of generally opposed elongate connection slots with each elongate connection slot sized to receive a releasable support of a suspended ceiling panel to secure the ceiling panel beneath said grid system and in a predetermined configuration with said visual surface of said visual nodes and said suspended ceiling panels collectively defining a finished surface of said ceiling system.

2. A suspended ceiling system as claimed in claim 1 wherein said at least one predetermined geometric configuration includes at least five arms extending outwardly from said central port.

3. A suspended ceiling system as claimed in claim 1 wherein said predetermined geometric configuration includes at least six arms and a rectangular central port and said ceiling panels are of a triangular shape or diamond shape with truncated corners.

4. A suspended ceiling system as claimed in claim 1 wherein said connection plate includes six arms, and wherein the projection of said arms define points of intersection at positions spaced from a center point of said visual node.

5. A suspended ceiling system as claimed in claim 1 wherein said visual surface is a perimeter frame about said downwardly extending collar.

6. A suspended ceiling system as claimed in claim 1 wherein said connection plates are shaped to define a non rectilinear grid when said grid members are connected thereto.

7. A suspended ceiling system as claimed in claim 1 wherein the central port is rectangular in shape having sides of at least 12 inches.

8. A suspended ceiling system as claimed in claim 7 wherein said central port includes a removable access plate covering said central port at a level spaced downwardly from the bottom surface of said connection plate and spaced upwardly from a finished surface of said ceiling panels.

9. A suspended ceiling system comprising a grid system having a series of visual nodes interior to a peripheral edge of said grid system connected to adjacent visual nodes by grid members;

said series of visual nodes each including a connection plate with a series of guide tracks on a bottom surface thereof receiving and cooperating with an upper flange of said grid members to align said grid members in at least one predetermined geometric configuration;

each connection plate including a central port of a size to receive 1) a light fixture or 2) to provide an access port accessing the ceiling system above said grid system; and wherein said access port includes a suspended removable cover with a finished lower surface spaced downwardly from said connection plate and upwardly from a finished lower surface of suspended ceiling panels to provide a multilevel ceiling system.

10. A suspended ceiling system as claimed in claim 9 wherein some of said visual nodes receive a light fixture that projects downwardly through said central port and has a lower surface positioned above a lower surface of said suspended ceiling panels.

11. A suspended ceiling system as claimed in claim 9 wherein at least some of said visual nodes include a panel covering said central port and spaced downwardly therefrom and supporting a security component or an audio component.

12. A suspended ceiling system comprising grid members interconnected by nodes to define a grid network;

ceiling panels removably suspended below the grid network;

wherein each node includes a central port area that remains exposed between adjacent ceiling panels supported about a respective node and forms part of a finished visual area of said ceiling system; and wherein said central port area of said nodes receives a removable access panel providing limited access to the area above said grid network, receives a light fixture, receives a fixed finished conceal panel covering said central port area, receives a finished panel supporting a security device, audio device or fire related device, or receives a finished grill structure forming part of an air circulation system;

wherein said finished visual area is at an upwardly offset level relative to a finished surface defined by the lower surface of said suspended ceiling panels.

13. A suspended ceiling system as claimed in claim 12 wherein each node includes a flat stamped connection plate that includes a central port with a downwardly extending collar about said central port and terminating at a position to abut and partially overlap with said suspended ceiling panels supported adjacent said node.

14. A suspended ceiling system as claimed in claim 13 wherein each connection plate between adjacent guide tracks includes a pair of generally opposed elongate connection slots with each elongate connection slot sized to receive a support spring of a suspended ceiling panel to secure the ceiling panel beneath said grid system.

15. A suspended ceiling system as claimed in claim 14 wherein said connection plate includes six projecting arms with each arm including a guide track; and each of said guide tracks includes a downwardly projecting stop member.

* * * * *